US007786671B2

(12) United States Patent
Bascle

(10) Patent No.: US 7,786,671 B2
(45) Date of Patent: Aug. 31, 2010

(54) PHOTOMULTIPLIER TUBE WITH LEAST TRANSIT TIME VARIATIONS

(75) Inventor: Philippe Bascle, Malemort (FR)

(73) Assignee: Photonis, Brive la Gaillarde (FR)

( * ) Notice: Subject to any disclaimer, the term of this patent is extended or adjusted under 35 U.S.C. 154(b) by 473 days.

(21) Appl. No.: 11/815,693

(22) PCT Filed: Feb. 2, 2006

(86) PCT No.: PCT/FR2006/050090

§ 371 (c)(1),
(2), (4) Date: Aug. 7, 2007

(87) PCT Pub. No.: WO2006/085018

PCT Pub. Date: Aug. 17, 2006

(65) Prior Publication Data

US 2008/0258619 A1 Oct. 23, 2008

(30) Foreign Application Priority Data

Feb. 9, 2005 (FR) ..... 05 50383

(51) Int. Cl.
*H01J 17/24* (2006.01)

(52) U.S. Cl. ..... 313/553; 250/207

(58) Field of Classification Search ..... 313/533, 313/553; 250/207
See application file for complete search history.

(56) References Cited

U.S. PATENT DOCUMENTS

| | | | | |
|---|---|---|---|---|
| 3,099,764 | A | 7/1963 | McDonie et al. | |
| 4,881,008 | A | 11/1989 | Kyushima et al. | |
| 5,077,504 | A * | 12/1991 | Helvy | 313/103 R |
| 5,504,386 | A * | 4/1996 | Kyushima et al. | 313/103 R |
| 2004/0251417 | A1 * | 12/2004 | Yamaguchi et al. | 250/367 |
| 2005/0212421 | A1 * | 9/2005 | Kimura et al. | 313/532 |

FOREIGN PATENT DOCUMENTS

| | | |
|---|---|---|
| EP | 0 487 178 A2 | 5/1992 |
| EP | 1 211 173 A2 | 6/2002 |
| FR | 1 288 477 A | 3/1962 |

* cited by examiner

*Primary Examiner*—Toan Ton
*Assistant Examiner*—Hana A Sanei
(74) *Attorney, Agent, or Firm*—Oblon, Spivak, McClelland, Maier & Neustadt, L.L.P.

(57) ABSTRACT

A single-channel photomultiplier tube having a sealed envelope, of which one wall includes an internal face having a concavity with a central axis, turned toward the inside of the tube, having a plane of symmetry and containing a photocathode, inlet optics including electrodes, an electron multiplier including a plurality of dynodes, an anode, and a mechanism connecting the dynodes, the photocathode, electrodes of the optics, and the anode, at their respective operating voltages. The electron multiplier is composed of parts physically distinct from one another, and having between them a symmetry of revolution with respect to the central axis of the concavity.

6 Claims, 1 Drawing Sheet

PHOTOMULTIPLIER TUBE WITH LEAST TRANSIT TIME VARIATIONS

TECHNICAL FIELD

This invention relates to a single-channel electron multiplier tube.

PRIOR ART

A photomultiplier tube generally comprises, inside a sealed gas-free envelope, a light-sensitive electrode, called a photocathode, electron focusing optics, an electron multiplier for multiplying the electrons emitted by the photocathode and an anode that collects the multiplied electrons.

The patent application FR 1.288.477 corresponding to the US patent having the filing number 27066, granted to the Radio Corporation of America, describes, in association with the single FIGURE of this patent, a single-channel photomultiplier tube, comprising a sealed envelope 10. The sealed envelope 10 comprises a wall forming a photon-transparent window 12. The window 12 has an external face and an internal face. The internal face has a concavity with a central axis. The concavity is turned toward the inside of the tube. It has a plane of symmetry containing the central axis.

A photocathode 14 is arranged on the internal face of the wall forming the transparency window so as to receive light photons having passed through the transparency window.

Focusing optics comprising a plurality of electrodes focus the electrons coming from the photocathode on a first dynode 31 of an electron multiplier with a focused linear structure located downstream of the optics in the direction of travel of the electrons. The multiplier comprises a plurality of dynodes 31-40 including a first dynode 31, intermediate dynodes, a penultimate dynode and a final dynode. The tube also comprises an anode 42. Connection means 18 pass through the sealed envelope 10 and comprise contacts 18 for external connection to the envelope 10, themselves connected to internal electrical connections, and make it possible to respectively connect the dynodes, the photocathode 14, electrodes 16, 20, 22, 24 forming together the focusing optics, and the anode 42, at their respective operating voltages.

The single-channel tube described in this application is designed for uses in which the homogeneity of the transit time between the time at which an electron is emitted by the photocathode and a time at which an electron bunch resulting from the multiplication of this electron by the multiplier is an important factor. A perfect tube would have mutually equal transit times regardless of the site of emission on the photocathode and the initial energy of the electron emitted. In the single-channel tubes described above, the transit time dispersion between the photocathode and the first dynode of the multiplier is reduced by the fact that the photocathode is mounted on a hemispheric surface. Due to this form, the distance between the various points of the photocathode and a centre is equal. This geometry contributes to reducing the transit time dispersion according to the site of emission of an electron on the photocathode.

DESCRIPTION OF THE INVENTION

The invention relates to a single-channel photomultiplier tube having an improved time resolution with respect to the single-channel tubes known from the prior art. This objective is achieved by the fact that the tube contains an electron multiplier composed of a plurality of multiplier parts physically distinct from one another, and having between them a symmetry of revolution with respect to the central axis of concavity. Each multiplier part in fact constitutes an autonomous multiplier.

The hemispheric photocathode is thus virtually divided into as many cathode parts as there are multiplier parts. When the photocathode has a shape of revolution about an axis, the photocathode parts are angular sections of which the top coincides with the axis of revolution. Each photocathode section corresponds to a dedicated multiplier. Due to the symmetry of revolution, the sections are equal to one another. Thus, according to the invention, in an area where the electrons emitted by each of the photocathode sections are commonly focused by common focusing optics, there are as many first dynodes as there are sections. Each first dynode is a dynode of an autonomous multiplier multiplying the electrons coming from the photocathode sector corresponding to this dynode. Like all of the dynodes, these first dynodes of each of the multipliers are symmetrical of revolution with respect to the axis of the tube.

Since the electrons coming from only one photocathode section have trajectories with lower mutual angles of divergence than the mutual angles of divergence by the trajectories of the electrons coming from the entire cathode, and therefore lower differences in length of travel, the differences in transit time of the electrons from the photocathode to the first dynode of each multiplier are lower.

In addition, the trajectories of the electrons between the first dynode D1 and the second dynode D2 of each multiplier also have smaller mutual differences in length of travel than the differences in length of travel would be with a single large first dynode sending the electrons to a single large second dynode. Therefore, the differences in travel time of the electrons between the first and second dynodes of each multiplier are also reduced. The same is true, although to a lesser extent, for the times of travel between consecutive stages of each of the multipliers.

We thus obtain a single-channel tube having a lower transit time dispersion than that of the tubes of the prior art.

To summarise, the invention relates to a single-channel photomultiplier tube with lower transit time variations, comprising:

- a sealed envelope, having a wall forming a photon-transparent window comprising an external face and an internal face which has a concavity with a central axis, turned toward the inside of the tube, and having a plane of symmetry containing the central axis,
- a photocathode arranged on the internal face of the wall forming the transparency window so as to receive light photons having passed through the transparency window,
- focusing optics comprising one or more electrodes,
- an electron multiplier with a focused linear structure located downstream of the optics in the direction of travel of the electrons, comprising a plurality of dynodes including a first dynode, intermediate dynodes, a penultimate dynode and a final dynode,
- an anode,
- connection means passing through the sealed envelope and comprising contacts for external connection to the envelope, themselves connected to internal electrical connections, for respectively connecting the dynodes, the photocathode, electrodes forming together the focusing optics, and the anode, at their respective operating voltages, characterised in that the electron multiplier is composed of parts physically distinct from one another, with each part forming an autonomous multiplier, and the autonomous multipliers having between them a symmetry of revolution with respect to the central axis of concavity.

In an embodiment, the sealed envelope comprises a cylindrical insulating sleeve centred on the central axis of the concavity holding the photocathode, with the wall forming the transparency window being connected to an end of said sleeve, and the focusing optics comprise an accelerating and focusing electrode, a corrective focusing electrode formed by a conductive thin film in the form of a cylindrical surface part deposited on the internal wall of the sleeve having an end close to the photocathode in an area located between the photocathode and the accelerating electrode, promoting the initial acceleration of the photoelectrons in the peripheral area by increasing the electrical field in their vicinity.

In the preferred embodiment, the tube comprises two multipliers, the concavity is hemispheric and the focusing optics and the two multipliers comprise a plane of symmetry that is a plane of symmetry of the concavity. This solution makes it possible to arrange two multipliers in parallel with a common axis on the plane of symmetry.

In this embodiment, the angular sections are 180°.

In an alternative of the preferred embodiment, the first dynodes of each multiplier have a part that is closest to the photocathode which is tangential in the same point to said plane of symmetry and each having a concavity, wherein the respective concavities of each of the first dynodes are not turned toward one another. This solution makes it possible to arrange two multipliers in parallel with a common point on the plane of symmetry.

BRIEF DESCRIPTION OF THE DRAWINGS

The invention can now be described with reference to the appended drawings in which.

DETAILED DESCRIPTION OF SPECIFIC EMBODIMENTS

Figure 1:
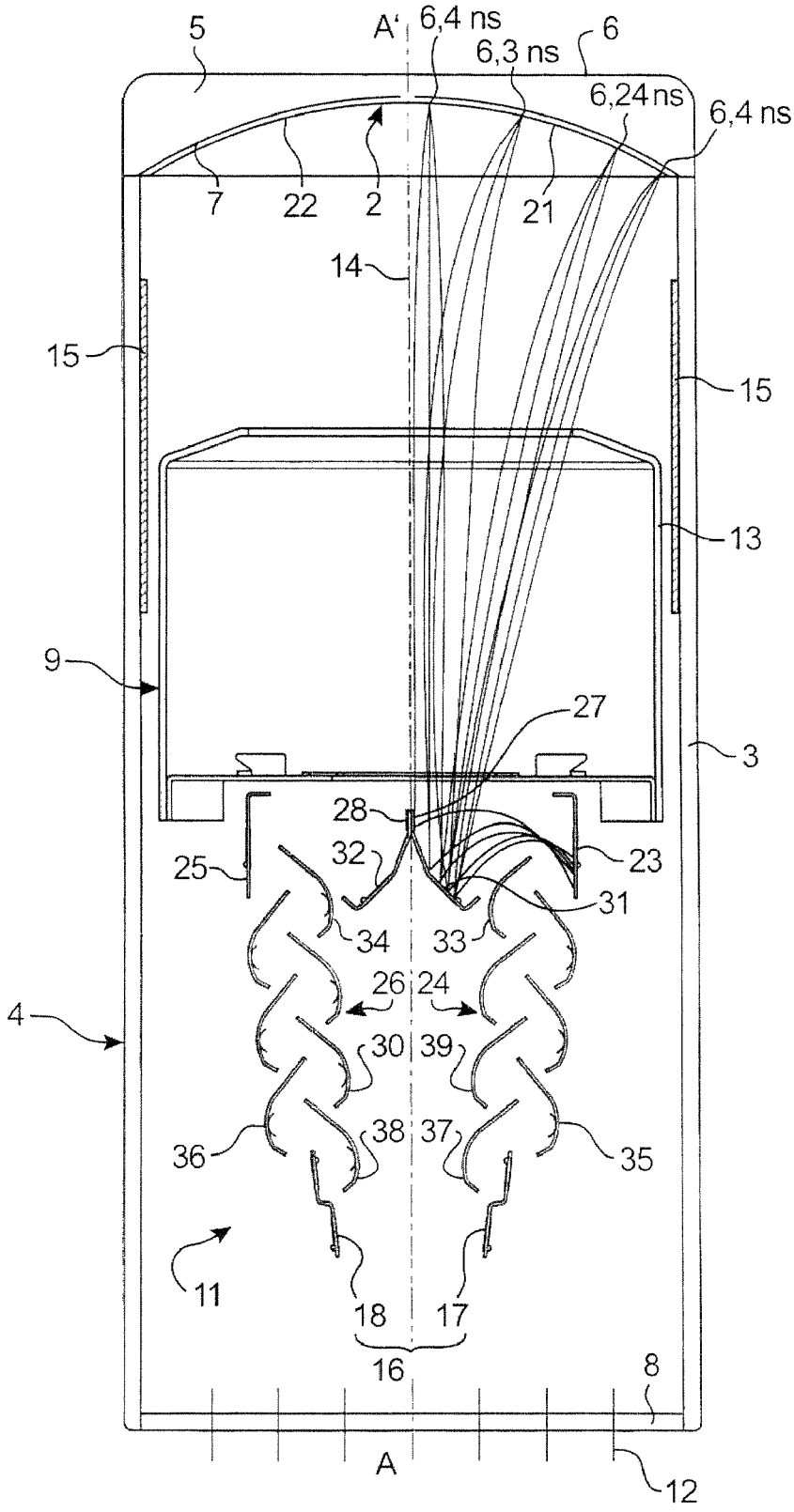
FIG. 1 shows a longitudinal cross-section of a photomultiplier tube according to the invention, produced according to a plane of symmetry of the tube. Electron trajectories in this plane of symmetry, between a first half of a photocathode and the first dynode of a first electron multiplier, are also shown.

FIG. 1 shows a longitudinal cross-section of a photomultiplier tube 1 with two multipliers according to the invention.

The photomultiplier tube 1 comprises a sealed envelope 4, formed by a set of walls assembled together. In the example shown, a first wall 3 has a cylindrical sleeve shape, with an axis AA'. The cylindrical sleeve is preferably made of an insulating material, for example glass. The sleeve is completed at one end by a wall 5 forming a photon-transparent window. It is completed at the other end by a base wall 8. Connection pins 12 for the various electrodes located inside the sealed envelope 4 pass in a sealed manner, and in a manner known per se, through this base wall 8. When the tube is operating, these pins 12 are respectively coupled to voltage sources, applying operating voltages on the various electrodes of the tube.

The wall 5 forming the transparency window of the tube comprises an external planar face 6 and an internal face 7 having a concavity turned toward the inside of the tube. This concavity is, in the example shown, a spherical cap, of which the centre is located on the axis AA' of the tube. It therefore has a plane of symmetry shown in FIG. 1 by the axis AA'. FIG. 1 is an axial cross-section view according to a plane containing this axis of symmetry. A photocathode 2 is arranged on the internal face 7 of the wall 5 forming the transparency window 5, so as to receive light photons having passed through the transparency window 5. In a manner known per se, the photocathode 2 is constituted by a layer of a light-emitting material, for example a layer of a multi-alkaline material or silver-oxygen-caesium, or caesium-antimony. It can also be another light-emitting material. The material is chosen according to its spectral light-emitting properties and the wavelengths of the photons at which the photomultiplier tube will be applied. Fictitiously, the photocathode 2 comprises two parts 21, 22 mutually symmetrical with respect to a plane of symmetry, of which the intersection with the plane of the FIGURE is shown in FIG. 1 by the axis of symmetry AA'of the spherical cap.

From the photocathode 2 to the base wall 8, the tube comprises, in order, focusing optics 9 comprising an accelerating and focusing electrode 13. The focusing optics 9 can also comprise, as in the example shown, a focus-correcting electrode 15. In the example shown, this focus-correcting electrode 15 is formed by a conductive thin film in the form of a cylindrical surface part deposited on the lower face of the sleeve 3. The focus-correcting electrode 15 has, in the axial direction, an end close to the photocathode 2 in an area located between the photocathode 2 and a part that is farthest upstream of the accelerating and focusing electrode 13. In this document, the terms upstream and downstream refer to the direction of travel of the electron flow coming, at the start, therefore upstream, from the photocathode, and directed downstream, therefore toward the anode. The focusing optics 9 are thus common to the two autonomous multipliers 24, 26 of the tube 1.

Downstream of the focusing optics 9, the tube 1 comprises an electron multiplier 11 formed by an assembly of two multiplying parts 24, 26 physically distinct from one another and mutually symmetrical with respect to the plane of symmetry of the tube. These multiplier parts constitute autonomous multipliers 24, 26. Each of the multipliers 24, 26 comprises so-called Rajchman linear focusing structure dynodes. By physically distinct, we mean that the dynodes composing each of the multipliers are physically distinct of the dynodes composing the other multiplier. This does not rule out the possibility that dynodes of the same level as the two multipliers 24, 26 will be connected to the same voltage source, and therefore that there will be a common connection part. This common connection part can be outside or inside the envelope 4. Similarly, it does not rule out the possibility that two dynodes of the same level in each of the multipliers 24, 26 will have a point or an area of contact with one another.

Each electron multiplier 24, 26 comprises a plurality of dynodes including a first dynode 31, 32, respectively, a second dynode 23, 25, respectively, intermediate dynodes 33, 34, respectively, a penultimate dynode 35, 36, respectively, and a final dynode 37, 38, respectively, located downstream of the optics 9 in the direction of travel of the electrons.

Downstream of the final dynode 37, 38, in the direction of travel of the electrons, the tube comprises an anode 16 formed by two conductors 17, 18, respectively, electrically connected to one another to form a single anode of the multiplier 11.

Thus, a first multiplication channel of the tube 1 is formed by the first half 21 of the photocathode 2, the common optics 9, the first multiplier 24, and the part 17 of the anode 16. The second multiplication channel of the tube 1 is formed by the second half 22 of the photocathode 2, the common optics 9, the second multiplier 26 and the part 18 of the anode 16.

In the example shown in FIG. 1, the dynodes 32, 34, 36, 38 and 31, 33, 35, 37 of the same level as the two multipliers 24, 26 with the exception of a gain setting dynode 30, 39 in each multiplier are connected to a single connection pin, respectively. The setting dynodes 30, 39, respectively, of each of the two multipliers 24, 26 have a connection allowing for a voltage setting independent of one another.

In the example shown in FIG. 1, the first dynodes 31, 32 of each multiplier 24, 26, respectively, are mutually symmetrical with respect to the plane of symmetry of the concavity of the transparency window 5. Each of these first dynodes 31, 32 has a part 27, 28, respectively, that is closest to the photocathode 2. The parts 27, 28 of each of the first dynodes 31, 32 are respectively tangential in the same point to one another and to said plane of symmetry. The first dynodes 31, 32 have a concavity of which the respective centres of curvature are mutually symmetrical with respect to the plane of symmetry. The centres of curvature of each of the first dynodes 31, 32, respectively, are located on the same side of the plane of symmetry as the corresponding dynode. It can be seen in FIG. 1 that each of the first dynodes is constituted by a set of four planar parts, with the curvature resulting from the fact that two consecutive planar parts form a dihedral. In the sectional plane shown, it is considered that a centre of curvature of a dihedral is the centre of the circle tangential to each of the two faces of the planar parts forming the dihedral.

The operation is as follows:

In a manner known per se, when an electron is emitted by the photocathode 2, this electron is accelerated and directed by the optics 9 to one or the other of the first dynodes 31, 32. Timed trajectories of electrons emitted by the part 21 of the photocathode 2 are shown in FIG. 1. The electrons coming from the part 21 are in the majority directed toward the first dynode 31 belonging to the first multiplier 24. The electrons are multiplied by the first dynode 31 of the first multiplier 24. The electrons coming from the first dynode 31 are projected onto the second dynode 23 of the first multiplier 24. The electrodes are then multiplied from dynode to dynode and the multiplied flow reaches the part 17 of the single anode 16.

The means of the various electron travel times between the photocathode 2 and the first dynode 31 of the first multiplier 24 appear opposite the starting points of the electrons on the photocathode 2. These mean travel times vary between 6.24 and 6.40 nanoseconds. The initial differences in travel times are therefore very low. These differences in travel time will also be attenuated during the multiplication. The improvement in the homogeneity of the travel times is due to the fact that there is less variation in the travel between the electrons coming from a section such as 21 or 22 of the photocathode and the first dynode of each multiplier. The same is true between the first and second dynode of each multiplier.

As the tube is symmetrical, everything said with regard to the first multiplication channel applies mutatis mutandis to the second multiplication channel. The electrons emitted by the second part 22 of the photocathode are directed in the majority toward the first dynode 32 of the second multiplier 26. The signal is received on the part 18 of the single anode 16.

In spite of the precautions taken in order to have the greatest possible symmetry between the two channels, the manufacturing tolerances mean that the two channels are not as symmetrical to one another as would be desirable. Therefore, it is advantageous to provide, in each of the multipliers 24, 26, a gain setting dynode 30, 39, respectively. The gain setting dynodes are dynodes that, unlike the other dynodes of the same level of each multiplier, are not connected to voltage sources of the same value. These dynodes 30, 39 therefore each have their own connection pin 12, which can be connected to a voltage source that is specific to each gain setting dynode. The dynodes 30, 39 make it possible to balance the overall gain of each of the multipliers 24, 26 and to obtain an equal transit time between multiplication channels.

The invention claimed is:

1. A single-channel photomultiplier tube, comprising:

a sealed envelope, including a wall forming a photon-transparent window having an external face and an internal face that has an internal concavity with a central axis, turned toward the inside of the tube, and having a plane of symmetry containing the central axis;

a photocathode arranged on the internal face of the wall forming the transparent window configured to receive light photons having passed through the transparent window;

focusing optics including one or more electrodes;

an electron multiplier with a focused linear structure located downstream of the optics in a direction of travel of the electrons, including a plurality of dynodes including a first dynode, intermediate dynodes, a penultimate dynode, and a final dynode;

an anode; and connection means passing through the sealed envelope and including contacts for external connection to the envelope, themselves connected to internal electrical connections, for respectively connecting the photocathode, the dynodes, electrodes forming together the focusing optics, and the anode, at their respective operating voltages, wherein the electron multiplier includes parts physically distinct from one another, with each part forming an autonomous multiplier, and the autonomous multipliers having between them a symmetry of revolution with respect to the central axis of the concavity.

2. A photomultiplier tube according to claim 1, wherein one of the dynodes of each multiplier part is a gain setting dynode, with each of the gain setting dynodes having its own connection means.

3. A photomultiplier tube according to claim 1, wherein the sealed envelope includes a cylindrical insulating sleeve centered on the central axis of the concavity holding the photocathode, with the wall forming the transparent window being connected to an end of the sleeve, and wherein the focusing optics includes an accelerating and focusing electrode, a corrective focusing electrode formed by a conductive thin film in a form of a cylindrical surface part deposited on the internal wall of the sleeve having an end close to the photocathode in an area located between the photocathode and the accelerating and focusing electrode.

4. A photomultiplier tube according to claim 1, wherein the internal concavity of the transparent window is hemispheric and the focusing optics and the two multiplier parts include a plane of symmetry that is a plane of symmetry of the concavity.

5. A photomultiplier tube according to claim 4, wherein the first dynodes of each multiplier part have a part that is closest to the photocathode, which is tangential in a same point to the plane of symmetry and each having a concavity, wherein the respective concavities of each of the first dynodes are not turned toward one another.

6. A photomultiplier tube according to claim 1, wherein the external face of the transparent window is planar.

* * * * *